US011835874B2

(12) United States Patent
Sato et al.

(10) Patent No.: US 11,835,874 B2
(45) Date of Patent: Dec. 5, 2023

(54) TONER

(71) Applicant: CANON KABUSHIKI KAISHA, Tokyo (JP)

(72) Inventors: Kazuyuki Sato, Kanagawa (JP); Tomohisa Sano, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 89 days.

(21) Appl. No.: 17/377,510

(22) Filed: Jul. 16, 2021

(65) Prior Publication Data

US 2022/0026822 A1 Jan. 27, 2022

(30) Foreign Application Priority Data

Jul. 22, 2020 (JP) ..... 2020-125092

(51) Int. Cl.
*G03G 9/087* (2006.01)
*G03G 9/093* (2006.01)

(52) U.S. Cl.
CPC ..... *G03G 9/09371* (2013.01); *G03G 9/0874* (2013.01); *G03G 9/08755* (2013.01); *G03G 9/08782* (2013.01); *G03G 9/09321* (2013.01)

(58) Field of Classification Search
None
See application file for complete search history.

(56) References Cited

U.S. PATENT DOCUMENTS

| | | | |
|---|---|---|---|
| 6,309,788 | B1 | 10/2001 | Tsuji |
| 6,953,648 | B2 | 10/2005 | Tsujino |
| 7,123,862 | B2 | 10/2006 | Hasegawa et al. |
| 7,494,758 | B2 | 2/2009 | Tsujino |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,923,190 | B2 | 4/2011 | Magome et al. |
| 7,935,467 | B2 | 5/2011 | Dojo et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,440,382 | B2 | 5/2013 | Isono |
| 8,497,054 | B2 | 7/2013 | Sugiyama |
| 8,518,620 | B2 | 8/2013 | Dojo et al. |
| 8,545,133 | B2 | 10/2013 | Fumita |
| 8,614,044 | B2 | 12/2013 | Matsui et al. |
| 8,652,725 | B2 | 2/2014 | Watanabe |
| 8,652,737 | B2 | 2/2014 | Handa |
| 8,778,581 | B2 | 7/2014 | Nonaka |
| 8,778,585 | B2 | 7/2014 | Matsui et al. |
| 8,841,054 | B2 | 9/2014 | Dojo et al. |
| 8,916,319 | B2 | 12/2014 | Ikeda |
| 8,940,467 | B2 | 1/2015 | Hashimoto |
| 9,152,065 | B2 | 10/2015 | Sano et al. |
| 9,229,345 | B2 | 1/2016 | Ikeda |
| 9,235,151 | B2 | 1/2016 | Tanaka et al. |
| 9,341,967 | B2 | 5/2016 | Tsujino |
| 9,366,981 | B2 | 6/2016 | Yamawaki |
| 9,377,708 | B2 | 6/2016 | Magome et al. |
| 9,551,947 | B2 | 1/2017 | Hiroko et al. |
| 9,632,441 | B2 | 4/2017 | Abe |
| 9,658,551 | B2 | 5/2017 | Terui |
| 9,785,077 | B2 | 10/2017 | Abe |
| 9,804,514 | B2 | 10/2017 | Suzumura et al. |
| 9,804,519 | B2 | 10/2017 | Suzumura et al. |
| 9,829,814 | B2 | 11/2017 | Yoshida |
| 9,841,692 | B2 | 12/2017 | Hasegawa et al. |
| 9,857,711 | B2 | 1/2018 | Yoshida |
| 9,927,728 | B2 | 3/2018 | Arimura et al. |
| 9,946,179 | B2 | 4/2018 | Arimura et al. |
| 9,946,181 | B2 | 4/2018 | Hasegawa et al. |
| 9,964,874 | B2 | 5/2018 | Suzumura et al. |
| 9,964,879 | B2 | 5/2018 | Terui |
| 9,964,881 | B2 | 5/2018 | Ikejiri et al. |
| 9,971,262 | B2 | 5/2018 | Hasegawa et al. |
| 9,971,264 | B2 | 5/2018 | Sano et al. |
| 10,012,922 | B2 | 7/2018 | Yoshida |
| 10,012,923 | B2 | 7/2018 | Sano et al. |
| 10,078,285 | B2 | 9/2018 | Kubo |
| 10,151,990 | B2 | 12/2018 | Suzuki et al. |
| 10,228,627 | B2 | 3/2019 | Nagashima et al. |
| 10,295,920 | B2 | 5/2019 | Nishikawa et al. |
| 10,295,922 | B2 | 5/2019 | Terui |
| 10,303,075 | B2 | 5/2019 | Tanaka et al. |
| 10,310,397 | B2 | 6/2019 | Sano et al. |
| 10,545,420 | B2 | 1/2020 | Kinumatsu et al. |
| 10,678,155 | B2 | 6/2020 | Terui |
| 10,698,327 | B2 | 6/2020 | Nagashima et al. |
| 10,747,133 | B2 | 8/2020 | Yagi |
| 10,747,136 | B2 | 8/2020 | Kenmoku |
| 10,852,650 | B2 | 12/2020 | Inoue |
| 11,079,695 | B2 | 8/2021 | Sato et al. |

(Continued)

FOREIGN PATENT DOCUMENTS

| | | | | |
|---|---|---|---|---|
| JP | 2005107182 | A | * | 4/2005 |
| JP | 2009-134079 | A | | 6/2009 |
| JP | 2015-22237 | A | | 2/2015 |
| JP | 2018-4748 | A | | 1/2018 |
| JP | 2019-128434 | A | | 8/2019 |
| JP | 2019128434 | A | * | 8/2019 |
| WO | 2013/047296 | A1 | | 4/2013 |

OTHER PUBLICATIONS

JP2019128434A translation (Year: 2023).*
JP2005107182A translation (Year: 2023).*
U.S. Appl. No. 17/377,488, filed Jul. 16, 2021, Tomohisa Sano.
Johann Gasteiger and Mario Marsili, "Iterative Partial Equalization of Orbital Electronegativity—A Rapid Access to Atomic Charges" Tetrahedron vol. 36, pp. 3219-3288 (1980).

*Primary Examiner* — Peter L Vajda
*Assistant Examiner* — Charles Collins Sullivan, IV
(74) *Attorney, Agent, or Firm* — VENABLE LLP

(57) ABSTRACT

A toner comprising a toner particle comprising a core particle comprising a binder resin and a wax, and a shell formed on a surface of the core particle, wherein the wax comprises a wax A, the shell comprises a resin comprising a functional group B, the wax A has a surface charge density DA of −0.0080 to −0.0025, and an absolute difference |DA−DB| between the surface charge density DA of the wax A and a surface charge density DB of the functional group B is not more than 0.0025.

9 Claims, No Drawings

(56) References Cited

U.S. PATENT DOCUMENTS

| | | | |
|---|---|---|---|
| 11,099,493 | B2 | 8/2021 | Komiya et al. |
| 11,112,710 | B2 | 9/2021 | Nakayama |
| 11,112,714 | B2 | 9/2021 | Amano |
| 11,599,035 | B2 | 3/2023 | Terui |
| 2005/0209364 | A1 | 9/2005 | Yamagishi et al. |
| 2006/0093942 | A1 | 5/2006 | Elda |
| 2006/0121379 | A1 | 6/2006 | Dojo et al. |
| 2009/0197192 | A1 | 8/2009 | Hiroko et al. |
| 2012/0264048 | A1 | 10/2012 | Ishikawa |
| 2013/0273465 | A1 | 10/2013 | Tanaka |
| 2014/0038097 | A1 | 2/2014 | Tanaka |
| 2014/0205944 | A1 | 7/2014 | Masuda |
| 2015/0024320 | A1 | 1/2015 | Tanaka |
| 2015/0212445 | A1 | 7/2015 | Terasaki |
| 2016/0349648 | A1 | 12/2016 | Miyamoto |
| 2016/0378003 | A1 | 12/2016 | Arimura et al. |
| 2017/0010552 | A1 | 1/2017 | Sumioka |
| 2019/0137901 | A1 | 5/2019 | Shimano |
| 2020/0379363 | A1 | 12/2020 | Nagaoka et al. |
| 2021/0063901 | A1 | 3/2021 | Terui |
| 2021/0063902 | A1 | 3/2021 | Inoue |
| 2021/0382406 | A1 | 12/2021 | Yamashita |

* cited by examiner

TONER

BACKGROUND OF THE INVENTION

Field of the Invention

The present disclosure relates to a toner used in an image-forming method, e.g., an electrophotographic method.

Description of the Related Art

Electrophotographic technology is technology in which an electrostatic latent image is formed on a uniformly charged photosensitive member and the image information is then made visible using a charged toner. The electrophotographic technology is used in devices such as copiers and printers. In recent years, copiers and printers have entered into use in new market regions, and there is thus demand for the ability to provide a favorable quality image on a stable basis notwithstanding use in diverse environments. On the other hand, further improvements in the low-temperature fixability are being required of the toner from the standpoints of increasing the speed and achieving greater energy conservation.

Japanese Patent Application Laid-open No. 2019-128434 describes a toner that is provided with an oxazoline group-containing shell layer in order to improve charge retention of the toner. A toner having an excellent charge retention, heat-resistant storability, and low-temperature fixability can be provided by the oxazoline group-containing shell layer. WO 2013/047296 describes a toner that contains a diester compound as a softening agent. A toner having an excellent low-temperature fixability, hot offset resistance, and heat-resistant storability can be provided by the use of the diester compound.

SUMMARY OF THE INVENTION

The effects of an excellent heat-resistant storability and a prevention of toner aggregation are present with the toner of Japanese Patent Application Laid-open No. 2019-128434. However, it has been found that after this toner has been subjected to long-term storage in a high-temperature, high-humidity environment, the problem of toner attachment to the back side of paper (back side contamination) may occur when a large number of image prints output by the printer are stacked. The effects of an excellent low-temperature fixability and heat-resistant storability and a prevention of toner aggregation are present with the toner of WO 2013/047296. However, it has been found that back side contamination and electrostatic offset may be produced when this toner is subjected to long-term storage in a high-temperature, high-humidity environment.

For these reasons the present disclosure provides a toner that exhibits little back side contamination and an excellent low-temperature fixability, heat-resistant stability, and resistance to electrostatic offset.

the present disclosure relates to a toner comprising a toner particle comprising a core particle comprising a binder resin and a wax, and a shell formed on a surface of the core particle, wherein the wax comprises a wax A, the shell comprises a resin comprising a functional group B, the wax A has a surface charge density DA of −0.0080 to −0.0025, and an absolute difference |DA−DB| between the surface charge density DA of the wax A and a surface charge density DB of the functional group B is not more than 0.0025.

The present disclosure can provide a toner that exhibits little back side contamination and an excellent low-temperature fixability, heat-resistant stability, and resistance to electrostatic offset. Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer to numerical value ranges that include the lower limit and upper limit that are the end points. When numerical value ranges are provided in stages, the upper limits and lower limits of the individual numerical value ranges may be combined in any combination.

The type and amount of wax exercises a large influence on improving the fixing performance of toner, and the present inventors also carried out investigations focusing on the type of wax. During these investigations, polar group-bearing ester waxes were excellent from the standpoint of the fixing performance.

By exuding to the toner particle surface during fixing, ester waxes promote melting of the toner particle surface and enable low-temperature fixing. However, with toner that is subjected to long-term storage in a high-temperature, high-humidity environment, wax exudation to the toner particle surface impedes the suppression of electrostatic offset and impedes the suppression of back side contamination.

Electrostatic offset is produced when, at the stage prior to entry of the unfixed toner-bearing paper into the nip between the fixing member and pressure roller, the toner on the paper undergoes random electrostatic flight onto the fixing member.

With regard to the mechanism for the generation of electrostatic offset, first the wax exudes to the toner particle surface due to long-term storage in a high-temperature, high-humidity environment and large domains are formed due to wax-to-wax aggregation and crystallization. As a result, the toner particle surface assumes a nonuniform composition and the charge distribution on the toner then broadens and electrostatic offset is thought to be produced due to this.

Back side contamination, on the other hand, occurs because the post-fixing attachment force between the paper and toner is low and the toner then attaches to the back side of the stacked paper. There are thought to be multiple mechanisms underlying the occurrence of back side contamination. In one case, it is thought that surface melting by the toner particle is inadequate and unfixed toner attaches to the back side of the paper; in another case, it is thought that the toner does undergo satisfactory melting and the reduced-viscosity toner attaches to the back side of the paper.

A cause of inadequate surface melting by the toner particle is an inadequate exudation of the wax to the toner particle surface during fixing. In addition, during long-term storage in a high-temperature, high-humidity environment, the wax exudes to the toner particle surface and the toner particle surface assumes a nonuniform composition, and as a result the charge distribution on the toner broadens and the toner laid-on level during development becomes nonuniform.

The present inventors therefore thought that it may be possible to achieve the suppression of occurrence of back side contamination and electrostatic offset and the low-temperature fixability if there were no change in the charging performance of the toner even for the state in which the wax has exuded to the toner particle surface.

As a result of intensive investigations, the present inventors discovered that the problem of the occurrence of electrostatic offset and back side contamination could be solved if—for a toner particle having a wax-containing core particle and having a shell formed on the surface of this core particle—the ease of wax exudation to the toner particle surface could be adjusted and the affinity between the wax and shell were high.

As a result of additional investigations, it was found that the problem of the occurrence of electrostatic offset and back side contamination could be solved by adjusting the surface charge density of the wax into a certain range, in order to adjust the ease of wax exudation to the toner particle surface, and by lowering the absolute difference between the surface charge density of the wax and the surface charge density of the functional group in the shell, in order to raise the affinity between the wax and shell.

That is, the present disclosure relates to a toner comprising a toner particle comprising a core particle comprising a binder resin and a wax, and a shell formed on a surface of the core particle, wherein the wax comprises a wax A, the shell comprises a resin comprising a functional group B, the wax A has a surface charge density DA of −0.0080 to −0.0025, and an absolute difference |DA−DB| between the surface charge density DA of the wax A and a surface charge density DB of the functional group B is not more than 0.0025.

These surface charge densities DA and DB are obtained by calculating the topological polar surface area (tPSA) and partial charge in accordance with the article indicated below and calculating the partial charge per unit topological polar surface area.

"Iterative partial equalization of orbital electronegativity—a rapid access to atomic charges" Tetrahedron 1980, 36, 3219.

Specifically, the topological polar surface area (tPSA) and partial charge can be calculated using Advanced Chemistry Development (ACD/Labs) Software V11.02 (c1994-2016, ACD/Labs).

The wax exudes to the toner particle surface to a suitable degree when the ranges indicated above are satisfied by the surface charge density of the wax and the absolute difference between the surface charge density of the wax and the surface charge density of the functional group contained in the shell. In addition, because the exuded wax has a high affinity with the shell, large wax domains are not formed and a uniform composition is maintained in the vicinity of the toner particle surface. As a result, a broadening of the charge distribution on the toner does not occur and deviations in the toner laid-on level are substantially reduced and the occurrence of back side contamination can be thoroughly suppressed.

When the surface charge density DA of the wax A exceeds −0.0025, a satisfactory wax exudation does not occur even during fixing and surface melting of the toner particle is not promoted, and due to this the fixing performance undergoes a large decline and the effect of suppressing back side contamination is also not obtained.

When the surface charge density DA of the wax A is less than −0.0080, toner that has undergone long-term storage in a high-temperature, high-humidity environment exhibits a broadening of the charge distribution on the toner due to the exudation of large amounts of the wax. As a consequence, electrostatic offset is produced from the beginning of printing and the effect of suppressing back side contamination is also not obtained.

The surface charge density DA is preferably −0.0050 to −0.0030 and is more preferably −0.0040 to −0.0030.

The absolute difference (|DA−DB|) between the surface charge density DA of the wax A and the surface charge density DB of the functional group B is not more than 0.0025. When the absolute difference (|DA−DB|) exceeds 0.0025, the wax exuded to the toner particle surface forms domains and a nonuniform composition is then assumed by the toner particle surface, and the charge distribution on the toner broadens due to this. As a result, after a durability test in which the toner undergoes deterioration, electrostatic offset occurs and the effect of suppressing back side contamination is also not obtained.

The absolute difference (|DA−DB|) is preferably not more than 0.0020 and more preferably not more than 0.0015. The lower limit is not particularly limited, but is preferably at least 0.0000 and more preferably at least 0.0005.

The shell used for the toner is not particularly limited as long as the resin contains a functional group B that satisfies the surface charge density indicated above.

The surface charge density DB of the functional group B is preferably −0.0050 to −0.0015 and is more preferably −0.0030 to −0.0020.

Functional group B is preferably an oxazoline group. In this case, the shell and core particle of the toner readily crosslink and the durability of the shell is substantially improved, and due to this charge broadening is suppressed on a long-term basis and the electrostatic offset can be further improved.

A vinyl resin is preferred for the resin that contains the functional group B (preferably an oxazoline group). Favorable examples of this vinyl resin are polymers and copolymers of monomer comprising a vinyl compound given by formula (2).

That is, the vinyl resin preferably has the structure given by the following formula (2B).

(2)

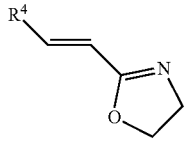

(2B)

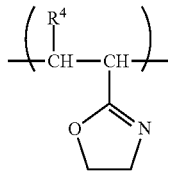

In formulas (2) and (2B), $R^4$ represents a hydrogen atom or an alkyl group. The alkyl group represented by $R^4$, for example, is preferably an alkyl group having from 1 to 6 carbon atoms, with the methyl group, ethyl group, and isopropyl group being more preferred. $R^4$ is more preferably a hydrogen atom.

2-Vinyl-2-oxazoline is a favorable example of a vinyl compound represented by formula (2).

A more favorable example of the vinyl resin is a copolymer of a vinyl compound represented by formula (2) with a vinyl compound other than the vinyl compound represented by formula (2).

The vinyl compound other than the vinyl compound represented by formula (2) can be exemplified by ethylene, propylene, butadiene, vinyl chloride, (meth)acrylic acid, (meth)acrylate esters, acrylonitrile, and styrene.

The (meth)acrylate ester is preferably an alkyl (meth) acrylate, and the number of carbons in the alkyl group is preferably 1 to 4. The alkyl (meth)acrylate is preferably methyl (meth)acrylate or ethyl (meth)acrylate and is more preferably methyl methacrylate.

The vinyl resin is preferably a copolymer of a vinyl compound represented by formula (2) and an alkyl (meth) acrylate. It is more preferably a copolymer of a vinyl compound represented by formula (2) and methyl methacrylate.

The content in the vinyl resin of the structure with formula (2B) is preferably 5 mass % to 98 mass % and is more preferably 20 mass % to 95 mass %.

For example, an aqueous solution of an oxazoline group-containing polymer ("Epocros (registered trademark) WS series", Nippon Shokubai Co., Ltd.) can be used in order to form the shell using a resin containing the oxazoline group as a functional group. "Epocros WS-300" and "Epocros WS-700" each contain a copolymer of 2-vinyl-2-oxazoline and an alkyl methacrylate.

The functional group contained in the shell is measured using surface analysis, e.g., TOF-SIMS, or with a pyrolysis GC/MS instrument.

The wax contains the wax A. The toner particle may contain, in addition to wax A, another known wax to a degree that does not impair the effects indicated above.

There are no particular limitations on the wax A as long as its surface charge density DA is −0.0080 to −0.0025; however, wax A preferably contains a diester wax and more preferably is a diester wax.

Examples of diester waxes are esters between a dicarboxylic acid and a monoalcohol and esters between a diol and a monocarboxylic acid.

The diol can be exemplified by 1,6-hexanediol, 1,7-heptanediol, 1,8-octanediol, 1,9-nonanediol, 1,10-decanediol, 1,11-undecanediol, and 1,12-dodecanediol.

The dicarboxylic acid can be exemplified by adipic acid, pimelic acid, suberic acid, azelaic acid, decanedioic acid, undecanedioic acid, and dodecanedioic acid.

Straight-chain fatty acids and straight-chain alcohols are provided here as examples, but branched structures may be present.

Aliphatic monoalcohols are preferred for the monoalcohol for condensation with the dicarboxylic acid. Specific examples are tetradecanol, pentadecanol, hexadecanol, heptadecanol, octadecanol, nonadecanol, eicosanol, docosanol, tricosanol, tetracosanol, pentacosanol, hexacosanol, and octacosanol. Docosanol is preferred among the preceding from the standpoints of fixing performance and developing performance.

Aliphatic monocarboxylic acids are preferred for the monocarboxylic acid for condensation with the diol. Specific examples are fatty acids such as lauric acid, myristic acid, palmitic acid, margaric acid, stearic acid, tuberculostearic acid, arachidic acid, behenic acid, lignoceric acid, and cerotic acid. Stearic acid and behenic acid are preferred among the preceding from the standpoints of fixing performance and developing performance.

The diester wax preferably is a compound given by the following formula (1).

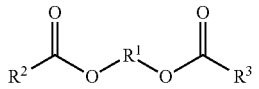

(1)

In formula (1), $R^1$ represents an alkylene group having from 2 to 12 (preferably from 2 to 8 and more preferably from 2 to 4) carbons. $R^2$ and $R^3$ represent a straight-chain alkyl group having from 15 to 25 (preferably from 16 to 22 and more preferably from 16 to 20) carbons, and $R^2$ and $R^3$ are independent from each other.

The diol that provides the substructure given in formula (1) can be exemplified by ethylene glycol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

Ethylene glycol and 1,9-nonanediol are preferred among the preceding, with ethylene glycol, in which $R^1$ is an alkylene group having 2 carbons, i.e., the ethylene group, being more preferred from the standpoints of compatibility with the binder resin and ease of exudation during heat fixing.

Aliphatic monocarboxylic acids are preferred for the monocarboxylic acid for condensation with the diol. Specific examples are fatty acids such as lauric acid, myristic acid, palmitic acid, margaric acid, stearic acid, tuberculostearic acid, arachidic acid, behenic acid, lignoceric acid, and cerotic acid. Stearic acid and behenic acid are preferred among the preceding from the standpoints of fixing performance and developing performance.

The content of the wax (preferably wax A) is preferably from 2 parts by mass to 30 parts by mass per 100 parts by mass of the binder resin. From 4 parts by mass to 25 parts by mass is more preferred, from 5 parts by mass to 20 parts by mass is still more preferred, and from 10 parts by mass to 20 parts by mass is even more preferred.

The melting point of the wax is preferably from 60° C. to 90° C. and is more preferably from 65° C. to 80° C. Back side contamination is more easily suppressed when this range is satisfied.

A paraffin wax may be used for the wax.

A specific example of the production of the diester wax with formula (1) is provided in the following.

The alcohol and carboxylic acid starting materials are first added to a reactor. The molar ratio between the alcohol and carboxylic acid is adjusted as appropriate in conformity with the chemical structure of the desired wax. Considering, for example, the reactivity in the dehydration condensation reaction, the alcohol or carboxylic acid may be added in some excess from this ratio.

The mixture is then heated as appropriate to carry out the dehydration condensation reaction. A basic aqueous solution and a suitable organic solvent are added to the crude esterification product provided by the dehydration condensation reaction and the unreacted alcohol and carboxylic acid are deprotonated and separated into the aqueous phase. The target diester wax is then obtained by carrying out a water wash, distillative removal of the solvent, and filtration as appropriate.

There are no particular limitations on the binder resin that can be used by the toner, and resins known for use in toners can be used.

Specific examples are vinyl resins, styrene resins, styrenic copolymer resins, polyester resins, polyol resins, polyvinyl chloride resins, phenolic resins, natural resin-modified phenolic resins, natural resin-modified maleic acid resins, acrylic resins, methacrylic resins, polyvinyl acetate, silicone resins, polyurethane resins, polyamide resins, furan resins, epoxy resins, xylene resins, polyvinyl butyral, terpene resins, coumarone-indene resins, and petroleum resins.

The following, for example, are preferred: styrenic copolymer resins, polyester resins, and hybrid resins provided by mixing a polyester resin with a vinyl resin or by partially reacting the two.

Viewed from the perspective of compatibility with the wax, polyester resins and vinyl resins are preferred among the preceding with polyester resins being more preferred.

The binder resin preferably includes a polyester resin, and from the viewpoint of low-temperature fixability, it is preferable that a polyester resin be a main component. The main component means that the amount thereof is 50% by mass to 100% by mass (preferably 80% by mass to 100% by mass). The binder resin is more preferably a polyester resin.

As a monomer to be used for the polyester resin, polyhydric alcohol (dihydric, trihydric or higher alcohol), polyvalent carboxylic acid (divalent, trivalent or higher carboxylic acid), acid anhydrides thereof or lower alkyl esters thereof are used.

The following polyhydric alcohol monomers can be used as a polyhydric alcohol monomer for the polyester unit of the polyester resin.

Examples of the dihydric alcohol component include ethylene glycol, propylene glycol, 1,3-butanediol, 1,4-butanediol, 2,3-butanediol, diethylene glycol, triethylene glycol, 1,5-pentanediol, 6-hexanediol, neopentyl glycol, 2-ethyl-1,3-hexanediol, hydrogenated bisphenol A, bisphenol represented by formula (A) and derivatives thereof.

(A)

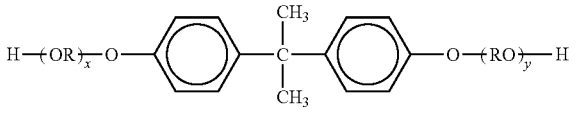

(in the formula, R is ethylene or propylene, x and y are each an integer of 0 or more, and the average value of x+y is from 0 to 10).

Diols represented by formula (B) can be mentioned.

(B)

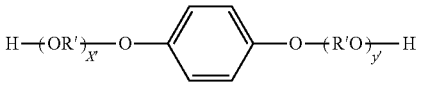

(In the formula, R' represents

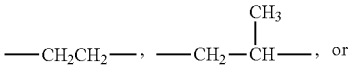

-continued

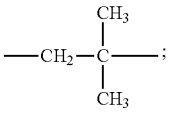

x' and y' are each integers greater than or equal to 0; and the average value of x'+y' is 0 to 10.)

Examples of the trivalent or higher alcohol component include sorbitol, 1,2,3,6-hexanetetrol, 1,4-sorbitan, pentaerythritol, dipentaerythritol, tripentaerythritol, and 1,2,4-butanetriol. 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among these, glycerol, trimethylolpropane and pentaerythritol are preferably used. These dihydric alcohols and trihydric or higher alcohols may be used singly or in combination of a plurality thereof.

The following polyvalent carboxylic acid monomers can be used as a polyvalent carboxylic acid monomer used for the polyester unit of the polyester resin.

Examples of the divalent carboxylic acid component include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, anhydrides of these acids, lower alkyl esters thereof and the like. Among these, maleic acid, fumaric acid, terephthalic acid and n-dodecenyl succinic acid are preferably used.

Examples of the trivalent or higher carboxylic acid, acid anhydrides thereof and lower alkyl esters thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof and lower alkyl esters thereof.

Among these, 1,2,4-benzenetricarboxylic acid, that is, trimellitic acid or a derivative thereof is particularly preferably used because it is inexpensive and the reaction control is easy. These divalent carboxylic acids and the like and trivalent or higher carboxylic acids can be used alone or in combination of a plurality thereof.

A method for producing the polyester resin is not particularly limited, and known methods can be used. For example, the above-mentioned alcohol monomer and carboxylic acid monomer are simultaneously charged and polymerized through an esterification reaction or a transesterification reaction and a condensation reaction to produce a polyester resin. The polymerization temperature is not particularly limited, but is preferably in the range of from 180° C. to 290° C. In the polymerization of the polyester resin, for example, a polymerization catalyst such as a titanium-based catalyst, a tin-based catalyst, zinc acetate, antimony trioxide, germanium dioxide or the like can be used. In particular, the binder resin is more preferably a polyester resin polymerized using a tin-based catalyst.

Various known colorants can be used in the toner. When, in the case of black toner, a magnetic body is used, this has little effect on the behavior of the wax and the effects described above are readily achieved, and this is thus preferred.

An example of a toner production method is described in the following.

Various methods, e.g., pulverization, suspension polymerization, aggregation, and so forth, can be used to produce the toner core particle. Pulverization is preferred from the standpoints of convenience and material selection.

An example of the pulverization method is described in the following. First, the binder resin and wax and optional additives such as colorant, charge control agent, and so forth are mixed using a stirring device such as a Henschel mixer. The resulting mixture is then melt-kneaded, followed by coarse pulverization and fine pulverization and classification of the resulting pulverized material. A toner core particle having a desired particle diameter is thereby obtained.

A shell is then formed on the surface of the resulting toner core particle. The shell is formed, for example, by dispersing the shell-forming material in an aqueous medium and adsorbing this material to the toner core particle surface. The shell material may dissolve in the aqueous medium. In addition, a polar medium (for example, an alcohol such as methanol, ethanol, and so forth) may be mixed into the aqueous medium.

The entire surface of the core particle need not be coated by the shell, and portions may be present where the core particle is exposed.

A toner particle dispersion is obtained by the execution of these steps. A toner particle is then obtained as necessary by the execution of filtration, a drying step, and a classification step. The toner particle may also optionally be mixed with an external additive using a mixer (for example, an FM mixer from Nippon Coke & Engineering Co., Ltd.) in order to attach the external additive to the toner particle surface.

The elements and step sequence in this toner production method may each be freely altered in conformity to, e.g., the constitution and properties required of the toner.

The methods for measuring the individual properties are described in the following.

Method for Measuring the Melting Point of the Waxes 6 mg to 8 mg of the wax sample is measured into the sample holder, and the DSC curve is obtained by carrying out measurement using a differential scanning calorimeter (product name: RDC-220, Seiko Instruments Inc.) and a ramp-up condition of 10° C./min from −20° C. to 100° C. The top of the peak in this DSC curve is taken to be the melting point.

Volume-Average Particle Diameter Dv of the Toner Particle

The volume-average particle diameter Dv, number-average particle diameter Dn, and particle diameter distribution Dv/Dn of the toner particle is measured using a particle diameter analyzer (product name: Multisizer, Beckman Coulter, Inc.). Measurement with the Multisizer is performed using the following conditions: aperture diameter: 100 μm, dispersion medium: ISOTON II (product name), 10% concentration, number of particles measured: 100,000.

Specifically, 0.2 g of the toner particle sample is taken to a beaker and an aqueous alkylbenzenesulfonic acid solution (product name: DRIWEL, Fujifilm Corporation) is added to this as a dispersing agent. 2 mL of the dispersion medium is additionally added to wet the toner particle, after which 10 mL of the dispersion medium is added, dispersion is carried out for 1 minute using an ultrasound disperser, and the measurement is then performed using the aforementioned particle diameter analyzer.

Structural Analysis of the Toner Shell

The functional groups in the toner shell are identified using time-of-flight secondary ion mass spectroscopy (TOF-SIMS). The following instrument is used under the following conditions to identify the substructures from the fragment peaks for the toner shell.

measurement instrument: TRIFT-IV (product name, ULVAC-PHI, Incorporated)

primary ion: $Au^{3+}$ raster size: 100 μm×100 μm neutralization electron gun: used Compositional Analysis of the Wax The compositional analysis of the wax in the toner particle can be carried out using nuclear magnetic resonance ($^{1}$H-NMR, $^{13}$C-NMR). The instrument used is described in the following.

Each sample may be acquired by fractionation from the toner and may then be submitted to analysis.

Nuclear magnetic resonance instrument ($^{1}$H-NMR, $^{13}$C-NMR)

Measurement instrument: JNM-EX400 FT-NMR instrument (JEOL Ltd.)

Measurement frequency: 400 MHz

Pulse condition: 5.0 μs

Frequency range: 10,500 Hz

Number of scans: 64

EXAMPLES

The present invention is described in additional detail in the following using examples and comparative examples. The present invention is in no way limited to or by the examples that follow.

Unless specifically indicated otherwise, the "parts" in the description of the examples in the following is on a mass basis.

The waxes used in the examples are indicated in Table 1.

TABLE 1

| Wax | | | Melting | Structures corresponding to formula (1) | |
|---|---|---|---|---|---|
| No. | Wax name | Wax structure | point | $R^1$ | $R^2$, $R^3$ |
| 1 | ethylene glycol distearate | diester wax | 75.7° C. | 2 | 17 |
| 2 | 1,9-nonanediol dibehenate | diester wax | 75.0° C. | 9 | 21 |
| 3 | 1,9-nonanediol distearate | diester wax | 68.0° C. | 9 | 17 |
| 4 | 1,12-dodecanediol distearate | diester wax | 68.2° C. | 12 | 17 |
| 5 | dibehenyl sebacate | diester wax | 73.3° C. | — | — |
| 6 | dibehenyl dodecanedioate | diester wax | 78.4° C. | — | — |

TABLE 1-continued

| Wax No. | Wax name | Wax structure | Melting point | Structures corresponding to formula (1) $R^1$ | $R^2$, $R^3$ |
|---|---|---|---|---|---|
| 7 | pentaerythritol tetrastearate | tetraester | 78.6° C. | — | — |
| 8 | dipentaerythritol hexastearate | hexaester | 77.2° C. | — | — |
| 9 | behenyl behenate | monoester | 74.8° C. | — | — |

Toner 1 Production Example

Production of Polyester Resin 1

The following materials were mixed in a reactor fitted with a condenser, stirrer, and nitrogen introduction line.

| | |
|---|---|
| polyoxypropylene(2.2)-2,2-bis(4-hydroxyphenyl)propane | 58.0 parts |
| ethylene glycol | 8.0 parts |
| terephthalic acid | 31.0 parts |
| trimellitic anhydride | 3.0 parts |
| dibutyltin oxide | 0.3 parts |

The interior of the system was subjected to nitrogen substitution by a pressure-reduction process, after which heating was carried out to 210° C. and a reaction was run for 5 hours while introducing nitrogen and removing the produced water. Then, while continuing to stir, the temperature was gradually raised to 230° C. under reduced pressure, and a polyester resin 1 was synthesized by reaction for an additional 3 hours. The weight-average molecular weight Mw was 9,500, and Tg was 68° C.

Magnetic Body Production 92.0 parts of an aqueous ferrous sulfate solution having an $Fe^{2+}$ concentration of 1.79 mol/L and 88.0 parts of a 3.74 mol/L aqueous sodium hydroxide solution were combined and were mixed by stirring. The pH of this solution was 6.5.

While maintaining this solution at a temperature of 89° C. and a pH of 9 to 12, an oxidation reaction was run by injecting air at 20 L/min to produce core particles. At the point at which the ferrous hydroxide had been completely consumed, air injection was halted and the oxidation reaction was ended. The resulting magnetic body core particles were composed of magnetite and had an octahedral shape. The magnetic bodies had the shape of an octahedron, and the number-average particle diameter (D1) was 120 nm.

Toner Core Particle 1 Production

The following materials were thoroughly mixed using an FM mixer (Nippon Coke & Engineering Co., Ltd.), followed by melt-kneading using a twin-screw kneader (Ikegai Iron Works Corporation).

| | |
|---|---|
| polyester resin 1 | 100.0 parts |
| "Acrybase (registered trademark) FCA-201-PS" from Fujikura Kasei Co., Ltd. | 3.0 parts |
| HNP9 (melting point: 76° C., Nippon Seiro Co., Ltd.) | 5.0 parts |
| wax 1 | 15.0 parts |
| magnetic body | 100.0 parts |

The resulting kneaded material was cooled and was coarsely pulverized to not more than 1 mm using a hammer mill to yield a coarse pulverizate.

A fine pulverizate of about 5 μm was then obtained from the resulting coarse pulverizate using a Turbo Mill from Turbo Kogyo Co., Ltd., followed by cutting the fines and coarse powder using a Coanda effect-based multi-grade classifier to obtain the toner core particle 1. Toner core particle 1 had a weight-average particle diameter (D4) of 6.8 μm and a Tg of 58° C.

Production of Toner Particle Dispersion 1

A reactor holding 300.0 parts of deionized water was maintained at 30° C., and 50.0 parts of an aqueous solution of an oxazoline group-containing polymer ("Epocros (registered trademark) WS-300" from Nippon Shokubai Co., Ltd., monomer mass ratio: methyl methacrylate/2-vinyl-2-oxazoline=1/9, solids concentration: 10 mass %) was then introduced into the reactor.

After thoroughly stirring the contents of the reactor, 300.0 parts of the toner core particle 1 was added and stirring was carried out for 1 hour at a rotation rate of 200 rpm. This was followed by the addition of 300.0 parts of deionized water.

6.0 parts of an aqueous ammonia solution with a concentration of 1 mass % was then added to the reactor, and, while stirring at a rotation rate of 150 rpm, the temperature in the reactor was raised to 60° C. at a rate of 0.5° C./minute.

After then bringing the temperature in the reactor to 60° C., the temperature of 60° C. was held for 1 hour while stirring the contents of the reactor at a rotation rate of 100 rpm. After the elapse of the 1 hour after bringing the temperature in the reactor to 60° C., 10.0 parts of an aqueous acetic acid solution having a concentration of 1 mass % was added to the reactor. Holding was subsequently carried out for 30 minutes at the temperature of 60° C. while stirring the contents of the reactor at a rotation rate of 100 rpm.

The pH in the reactor was then adjusted to 7 by the addition to the reactor of an aqueous ammonia solution having a concentration of 1 mass %. This was followed by cooling the contents of the reactor until the temperature of the contents reached normal temperature (approximately 25° C.), thus yielding toner particle dispersion 1.

Recovery of Toner Particle 1

Toner particle dispersion 1 was filtered and then redispersed in deionized water. Dispersion and washing were repeated until the electrical conductivity of the deionized water had been adequately reduced, to obtain a toner particle wet cake. This was then broken up and was thoroughly dried by residence for 70 hours in a 40° C. thermostat to obtain toner particle 1 in the form of a powder.

Toner 1 Production

Using an FM mixer ("FM-10B", Nippon Coke & Engineering Co., Ltd.), 100.0 parts of the toner particle was mixed for 5 minutes at a rotation rate condition of 3500 rpm with 1.0 parts of hydrophobic silica particles (3-aminopropyltriethoxysilane and dimethylsilicone oil were used as the hydrophobic treatment agents).

The coarse particles were subsequently removed using a 300-mesh sieve (aperture=48 μm) to yield toner 1. Table 2 gives the formulation and the obtained properties.

Toners 2 to 10 Production Example

Toners 2 to 10 were obtained proceeding as in the Toner 1 Production Example, but changing the type and amount of wax as indicated in Table 2. Table 2 gives the formulations and the obtained properties.

Toner 11 Production Example

Toner 11 was obtained according to proceeding as in the Toner 1 Production Example, except that the type and amount of wax were changed as indicated in Table 2, with 20.0 parts of "Epocros (registered trademark) WS-700" (monomer mass ratio: methyl methacrylate/2-vinyl-2-oxazoline/butyl acrylate=4/5/1, solids concentration: 25 mass %) being added in place of the 50.0 parts of "Epocros (registered trademark) WS-300" in the production of toner particle dispersion 1. Table 2 gives the formulation and the obtained properties.

Toner 12 Production Example

Toner 12 was obtained proceeding as in the Toner 1 Production Example, but changing the type and amount of wax as indicated in Table 2 and changing polyester resin 1 to the styrene-acrylic resin produced by the following production method. Table 2 gives the formulation and the obtained properties.

Production of Styrene-Acrylic Resin

The following materials were mixed in a reactor fitted with a condenser, stirrer, and nitrogen introduction line and were heated and held at 180° C. while stirring.

| | |
|---|---|
| styrene | 78.0 parts |
| n-butyl acrylate | 20.0 parts |
| acrylic acid | 2.0 parts |
| xylene | 300.0 parts |

A styrene-acrylic resin was then synthesized by continuously adding 50.0 parts of a 2.0 mass % xylene solution of t-butyl hydroperoxide dropwise to the system over 4.5 hours and, after cooling, separating and removing the solvent. The weight-average molecular weight Mw was 14,500, and Tg was 65° C.

Toner 13 Production Example

Toner 13 was obtained proceeding as in the production of toner 12, but changing the type and amount of wax as indicated in Table 2. Table 2 gives the formulation and the obtained properties.

Toner 14 Production Example

Toner 14 was obtained proceeding as for toner 1, except that in the production of toner particle dispersion 1, pH adjustment was not carried out and the following resin fine particle dispersion 1 was used in place of the aqueous solution of oxazoline group-containing polymer. 10.0 parts of the resin fine particle dispersion was added. Table 2 gives the formulation and the obtained properties.

Production of Resin Fine Particle Dispersion 1

30 parts of acetone was introduced into a reactor fitted with a condenser, stirrer, thermometer, and nitrogen introduction line and was stirred.

| | |
|---|---|
| methyl 2-acrylamidophenylsulfonate | 15.0 parts |
| styrene | 68.8 parts |
| n-butyl acrylate | 15.0 parts |
| acrylic acid | 1.2 parts |

These materials were introduced into the reactor and were dissolved. The interior of the reactor was heated to 60° C., followed by the addition of 2.0 parts of 2,2-azobis(2,4-dimethylvaleronitrile) as polymerization initiator and reaction for 8 hours. The reaction solution was cooled followed by condensation and drying using an evaporator and additional drying for 10 hours at 40° C. in a vacuum dryer to obtain a resin.

The obtained resin was redissolved in acetone with adjustment to provide a solids ratio of 75 mass %. Emulsification was then carried out by dropwise addition into 100.0 parts of deionized water while stirring, and the acetone was distilled off under a reduced pressure of 100 mmHg in the reactor. Dilution was performed to a solids ratio of 15 mass % to yield resin fine particle dispersion 1.

Toner 15 Production Example

Toner 15 was obtained proceeding as for toner 1, except that in the production of toner particle dispersion 1, pH adjustment was not carried out and the following resin fine particle dispersion 2 was used in place of the aqueous solution of oxazoline group-containing polymer. 10.0 parts of the resin fine particle dispersion was added. Table 2 gives the formulation and the obtained properties.

Production of Resin Fine Particle Dispersion 2

5.0 parts of sodium dodecyl sulfate and 1000.0 parts of deionized water were introduced into a beaker fitted with a stirrer, and stirring was continued at 25° C. until complete dissolution had occurred to prepare an aqueous solution. The following materials were then mixed to prepare a polymerizable monomer composition.

| | |
|---|---|
| styrene | 70.0 parts |
| butyl acrylate | 13.0 parts |
| 2-ethylhexyl acrylate | 12.0 parts |
| methyl methacrylate (MMA) | 5.0 parts |

The temperature of the polymerizable monomer composition was reduced to 15° C., followed by the admixture of 6.0 parts of tertiary-butyl peroxypivalate as polymerization initiator and introduction into the aforementioned aqueous solution. An emulsion of the polymerizable monomer composition was prepared by exposure for 13 minutes (1 second intermittent, maintenance of 25° C.) to ultrasound using a high-output ultrasound homogenizer (VCX-750).

This emulsion was introduced into a heat-dried reactor; the emulsion was bubbled with nitrogen for 30 minutes while stirring at 200 rpm; and stirring was then carried out for 6 hours at 70° C. Then, while being stirred, the emulsion was air-cooled to stop the reaction and yield a resin fine particle dispersion 2 of a styrene-acrylic resin that would become the outermost layer material.

Toners 16 to 18 Production Example

Toners 16 to 18 were obtained proceeding as in the Toner 1 Production Example, but changing the type and amount of wax as indicated in Table 2. Table 2 gives the formulation and the obtained properties.

Evaluation of Low-Temperature Fixability

Using an LBP 7600C that had been modified to enable adjustment of the fixation temperature, the low-temperature fixability was evaluated in a normal-temperature, normal-humidity environment (temperature of 23° C., 50% humidity) at a process speed of 300 mm/sec, while changing the fixation temperature in 5° C. steps beginning with 140° C.

Using the toner submitted for evaluation, a solid image with a toner laid-on level of 0.40 mg/cm$^2$ was produced on letter size Business 4200 paper (75 g/m$^2$, Xerox Corporation), and the fixed image was formed by the application of heat and pressure in an oilless system. The fixed image was rubbed 10 times using Kimwipes (S-200, Crecia Co., Ltd.) under a load of 75 g/cm$^2$, and the fixation temperature was taken to be the temperature at which the pre-rubbing-versus-post-rubbing reduction in the image density was less than 10%. The evaluation was performed based on the criteria given below.

An X-RITE 404A color reflection densitometer (X-Rite, Incorporated) was used for measurement of the image density. The relative density was measured versus the printed-out image of a white background region that had an original density of 0.00, and the percentage reduction in the image density post-rubbing was calculated. The results of the evaluation are given in Table 3. A score of A to C was regarded as satisfactory.

A: less than 150° C.

B: at least 150° C. and less than 160° C.

C: at least 160° C. and less than 170° C.

D: at least 170° C. and less than 180° C.

E: at least 180° C.

Evaluation of Electrostatic Offset

The electrostatic offset was evaluated both initially and after a durability test. The evaluation was performed using an HL-5470DW (Brother Industries, Ltd.) and was carried out in a normal-temperature, normal-humidity environment (temperature of 23° C., 50% humidity). A toner cartridge was used that had been held for 30 days in a high-temperature, high-humidity environment (temperature of 40° C., 95% humidity). In the initial evaluation, a discrete 1 dot halftone chart image was output and the electrostatic offset produced at the back end of the image was evaluated using the following evaluation criteria. A score of A to C was regarded as satisfactory.

A: Does not occur.

B: Level that can be faintly observed visually.

C: Level that can be visually observed, but is minor.

D: Occurrence can be clearly observed.

E: Occurrence over the entire area of the image.

For the evaluation after durability testing, horizontal lines providing a print percentage of 1% were output as the image in the durability test. After making 2000 prints using a two-print intermittent paper feed, a discrete 1 dot halftone chart image was output as in the initial evaluation and the electrostatic offset produced at the back end of the image was evaluated using the evaluation criteria provided above.

Evaluation of Back Side Contamination

The back side contamination was evaluated in a normal-temperature, normal-humidity environment (temperature of 23° C., 50% humidity) using an HL-5470DW (Brother Industries, Ltd.). Using a toner cartridge that had been held for 30 days in a high-temperature, high-humidity environment (temperature of 40° C., 95% humidity), 100 prints of a full-side solid image were output into the paper discharge tray and the image density was evaluated on the back side of the paper sheet that had been output second (area in content with the solid image on the first print). The image density was measured using a MacBeth reflection densitometer (MacBeth Corporation) with an SPI filter. A score of A to C was regarded as satisfactory.

A: the back side density is less than 0.02

B: the back side density is at least 0.02, but less than 0.05

C: the back side density is at least 0.05, but less than 0.10

D: the back side density is at least 0.10

TABLE 2

| Toner No. | Wax No. | Amount of addition (parts) | Shell functional group | DA | \| DA-DB \| |
|---|---|---|---|---|---|
| 1 | 1 | 15.0 | oxazoline group | −0.0035 | 0.0010 |
| 2 | 1 | 20.0 | oxazoline group | −0.0035 | 0.0010 |
| 3 | 2 | 20.0 | oxazoline group | −0.0035 | 0.0010 |
| 4 | 3 | 20.0 | oxazoline group | −0.0035 | 0.0010 |
| 5 | 4 | 20.0 | oxazoline group | −0.0035 | 0.0010 |
| 6 | 5 | 20.0 | oxazoline group | −0.0048 | 0.0023 |
| 7 | 5 | 25.0 | oxazoline group | −0.0048 | 0.0023 |
| 8 | 5 | 5.0 | oxazoline group | −0.0048 | 0.0023 |
| 9 | 5 | 3.0 | oxazoline group | −0.0048 | 0.0023 |
| 10 | 6 | 3.0 | oxazoline group | −0.0048 | 0.0023 |
| 11 | 5 | 3.0 | oxazoline group | −0.0048 | 0.0023 |
| 12 | 5 | 3.0 | oxazoline group | −0.0048 | 0.0023 |
| 13 | 6 | 3.0 | oxazoline group | −0.0048 | 0.0023 |
| 14 | 1 | 15.0 | methyl 2-acrylamidophenyl-sulfonate | −0.0035 | 0.0029 |
| 15 | 1 | 15.0 | methyl methacrylate | −0.0035 | 0.0066 |
| 16 | 7 | 15.0 | oxazoline group | −0.0018 | 0.0007 |
| 17 | 8 | 15.0 | oxazoline group | −0.0010 | 0.0015 |
| 18 | 9 | 15.0 | oxazoline group | −0.0096 | 0.0071 |

In the table, the amount of wax addition is in number of parts per 100 parts of the binder resin.

TABLE 3

| | Toner | Low-temperature fixability | Electrostatic offset (initial) | Electrostatic offset (after durability test) | Back side contamination | |
|---|---|---|---|---|---|---|
| Example 1 | Toner 1 | A | A | A | A | 0.00 |
| Example 2 | Toner 2 | A | A | A | A | 0.00 |
| Example 3 | Toner 3 | B | A | A | A | 0.01 |
| Example 4 | Toner 4 | B | A | A | A | 0.01 |
| Example 5 | Toner 5 | B | A | B | A | 0.01 |
| Example 6 | Toner 6 | B | B | B | B | 0.02 |
| Example 7 | Toner 7 | B | B | B | B | 0.04 |
| Example 8 | Toner 8 | B | B | B | B | 0.02 |
| Example 9 | Toner 9 | C | B | B | B | 0.02 |
| Example 10 | Toner 10 | C | B | B | B | 0.03 |
| Example 11 | Toner 11 | C | B | C | B | 0.04 |
| Example 12 | Toner 12 | C | B | B | B | 0.04 |

TABLE 3-continued

| | Toner | Low-temperature fixability | Electrostatic offset (initial) | Electrostatic offset (after durability test) | Back side contamination | |
|---|---|---|---|---|---|---|
| Example 13 | Toner 13 | C | B | C | B | 0.04 |
| Comparative Example 1 | Toner 14 | D | C | E | D | 0.12 |
| Comparative Example 2 | Toner 15 | D | C | E | D | 0.16 |
| Comparative Example 3 | Toner 16 | E | B | B | D | 0.12 |
| Comparative Example 4 | Toner 17 | E | B | B | D | 0.12 |
| Comparative Example 5 | Toner 18 | C | D | E | D | 0.14 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2020-125092, filed Jul. 22, 2020, which is hereby incorporated by reference herein in its entirety.

What is claimed is:

1. A toner, comprising:

a toner particle, the toner particle comprising a core particle comprising a binder resin and a wax, and a shell formed on a surface of the core particle;

the wax comprising a wax A represented by formula (1)

(1)

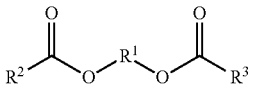

where $R^1$ represents an alkylene group having 2 to 12 carbons, and $R^2$ and $R^3$ independently represent a straight-chain alkyl group having 15 to 25 carbons; and the shell comprising a resin comprising a functional group B, wherein the functional group B is an oxazoline group, wherein wax A has a surface charge density DA of −0.0080 to −0.0025 e/Å$^2$, and an absolute difference |DA−DB| between the surface charge density DA of wax A and a surface charge density DB of functional group B is not more than 0.0025 e/Å$^2$.

2. The toner according to claim 1, wherein the resin comprising functional group B is a vinyl resin having a structure represented by formula (2B)

(2B)

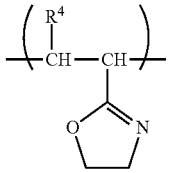

where $R^4$ represents a hydrogen atom or an alkyl group.

3. The toner according to claim 2, wherein a content of the structure represented by formula (2B) in the vinyl resin is 20 to 95 mass %.

4. The toner according to claim 1, wherein the wax A is a diester wax.

5. The toner according to claim 1, wherein $R^1$ is an alkylene group having 2 carbons.

6. The toner according to claim 1, wherein a content of wax A is 2 to 30 parts by mass based on 100 parts by mass of the binder resin.

7. The toner according to claim 1, wherein the binder resin comprises a polyester resin.

8. The toner according to claim 1, wherein wax A is a diester wax.

9. The toner according to claim 1, wherein $R^1$ is an alkylene group having 2 carbons.

* * * * *